US010107011B2

(12) United States Patent
Yang

(10) Patent No.: US 10,107,011 B2
(45) Date of Patent: Oct. 23, 2018

(54) COMBINATION LOCKING DEVICE

(71) Applicant: Henry Squire & Sons Ltd, Wolverhampton (GB)

(72) Inventor: Chi Gang Yang, Wolverhampton (GB)

(73) Assignee: HENRY SQUIRE & SONS LTD (GB)

( * ) Notice: Subject to any disclaimer, the term of this patent is extended or adjusted under 35 U.S.C. 154(b) by 0 days.

(21) Appl. No.: 15/349,291

(22) Filed: Nov. 11, 2016

(65) Prior Publication Data

US 2017/0138089 A1 May 18, 2017

(30) Foreign Application Priority Data

Nov. 13, 2015 (GB) ..... 1520045.4

(51) Int. Cl.

| | |
|---|---|
| ***E05B 37/02*** | (2006.01) |
| ***E05B 37/00*** | (2006.01) |
| ***E05B 15/16*** | (2006.01) |
| *E05B 67/00* | (2006.01) |

(52) U.S. Cl.

CPC ..... *E05B 37/025* (2013.01); *E05B 15/16* (2013.01); *E05B 37/0055* (2013.01); *E05B 67/00* (2013.01)

(58) Field of Classification Search

CPC .. E05B 37/0048; E05B 37/0055; E05B 37/02; E05B 37/025

See application file for complete search history.

(56) References Cited

U.S. PATENT DOCUMENTS 4,354,365 A 10/1982 Mayer et al.
4,532,784 A * 8/1985 Yeh ..... E05B 37/02 70/312
4,615,191 A * 10/1986 Grandy ..... E05B 37/02 403/328
5,109,684 A * 5/1992 Grandy, Sr. ..... E05B 37/025 70/25
5,142,888 A * 9/1992 Ling ..... E05B 37/025 70/26

(Continued)

FOREIGN PATENT DOCUMENTS

| | | |
|---|---|---|
| CN | 2916046 | 6/2007 |
| CN | 2923924 | 7/2007 |
| GB | 2031987 | 4/1980 |

OTHER PUBLICATIONS

Corresponding Search Report for GB1520045.4 dated Mar. 23, 2016. GB.

*Primary Examiner* — Christopher J Boswell

(74) *Attorney, Agent, or Firm* — The Belles Group, P.C.

(57) ABSTRACT

A combination locking device is disclosed. The device includes a spindle which is axially movable, has recesses in it and locking protrusion on it. Around the spindle are annular dials with markers on the outside and associated recesses on the inside. Between each dial and the spindle are gate wheels which have apertures extending radially from the spindle to the dial. The gate wheels also have recesses matching the locking protrusions and when the protrusions and recesses are aligned and the spindle moved axially the gate wheels are rotatably fixed to the spindle. A plurality of locking balls is located within the apertures. Axial movement of the spindle selects device conditions including a code change condition where the locking balls are able to enter the spindle recesses freeing them from the dial recesses and allowing the dials to move around the gate wheels.

13 Claims, 5 Drawing Sheets

(56) References Cited

U.S. PATENT DOCUMENTS

| | | | | |
|---|---|---|---|---|
| 6,058,744 | A * | 5/2000 | Ling | E05B 37/025 70/28 |
| 6,845,643 | B2 * | 1/2005 | Tsai | E05B 37/0031 70/26 |
| 8,596,103 | B2 * | 12/2013 | Weiershausen | E05B 37/025 70/312 |
| 9,340,327 | B2 * | 5/2016 | Misner | B65D 33/16 |

* cited by examiner

COMBINATION LOCKING DEVICE

CROSS-REFERENCE TO RELATED APPLICATIONS

This application claims the benefit of GB Patent Application No. 1520045.4, filed on Nov. 13, 2015. The disclosure of the above application is incorporated herein by reference.

FIELD OF THE INVENTION

The present invention relates to a combination locking device and relates particularly, but not exclusively, to a combination padlock.

BACKGROUND

The use of combination locks, such as padlocks, is well known and it is particularly desirable to have a lock which an operator can change the combination code when they wish to. An example of such a combination lock is disclosed in our earlier European patent application published under the number EP1837466. The combination lock disclosed therein uses clutch wheels, associated with each dial, to allow the combination to be changed. In a code change condition the clutch wheels are fixed and the dials can be moved over the clutch wheels so that a new code becomes associated with the unlocking position for the padlock. However, in order to ensure that the padlock does not become accidentally recoded it is necessary that the force required to move the dials relative to the clutch wheels is quite high and it is therefore necessary to use a tool to apply sufficient force to the dial. Although the tool required is simply a small rod, the rod supplied with the padlock or another suitable tool may not be conveniently available when the operator wishes to change the code.

In order to ensure correct alignment of the clutch wheel and dial the external surface of the former and internal surface of the latter are provided with a series of ridges and associated grooves, one for each number on the dial, which should be aligned with each other. However, it is possible, in principle, for the ridges and grooves to be incorrectly aligned when the dials are recoded. In this instance when an operator comes to try and unlock the padlock using the code they had intended the padlock will not unlock.

BRIEF SUMMARY

The present invention is directed to a combination locking device comprising: a housing; a spindle axially movable within said housing and having a plurality of recesses formed therein; a plurality of annular dials accessible through said housing for manipulation by an operator, the dials having a plurality of markers visible on an external surface thereof and having a plurality of recesses, associated with said markers, on an internal surface; a plurality of gate wheels each having at least one aperture extending therethrough providing a pathway between said spindle and said internal surface of said dials; a plurality of first locking members for allowing and preventing rotation of said spindle relative to said wheels; and a plurality of second locking members located within said apertures for allowing and preventing rotation of said wheels relative to said dials. The spindle is movable to produce a plurality of device conditions including a locked condition wherein said wheels are rotatable around said spindle and said apertures are not aligned with said spindle recesses so that said wheels are locked to said dials by said second locking members and a code change condition wherein said wheels are locked to said spindle by said first locking members and said apertures are aligned with said spindle recesses so that said second locking members can move thereby allowing said dials to move relative to said wheels.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings. Preferred embodiments of the present invention will now be described, by way of example only, and not in any limitative sense with reference to the accompanying drawings wherein:

FIG. 5 is a perspective view of the spindle component of the device of FIG. 1;

DETAILED DESCRIPTION

Figure 1:
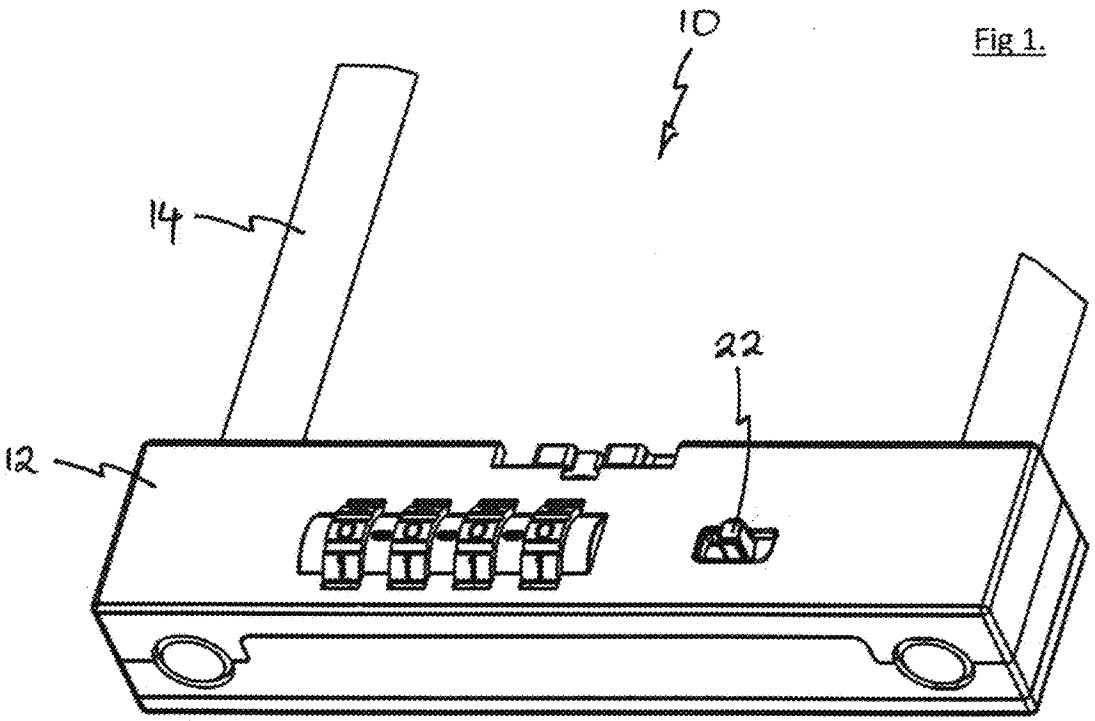
FIG. 1 is a perspective view of a device of the present invention.
Figure 2:
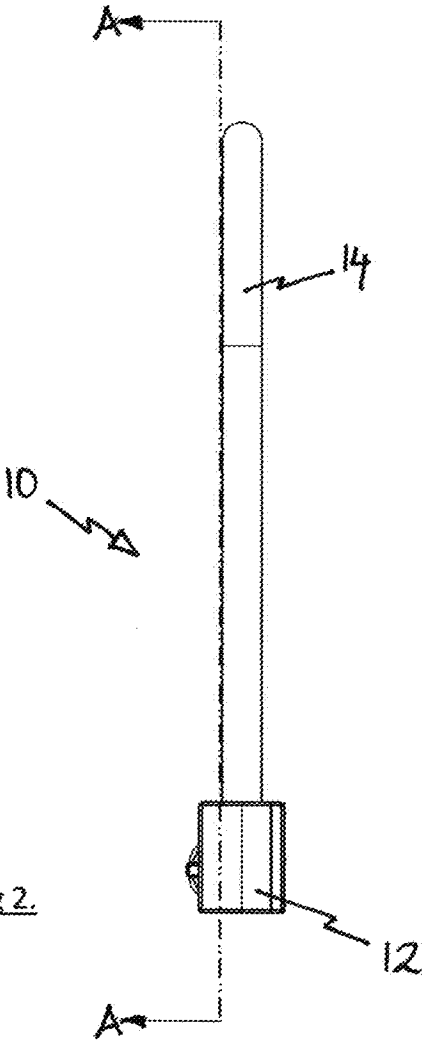
FIG. 2 is a side view of the device of FIG. 1.
Figure 3:
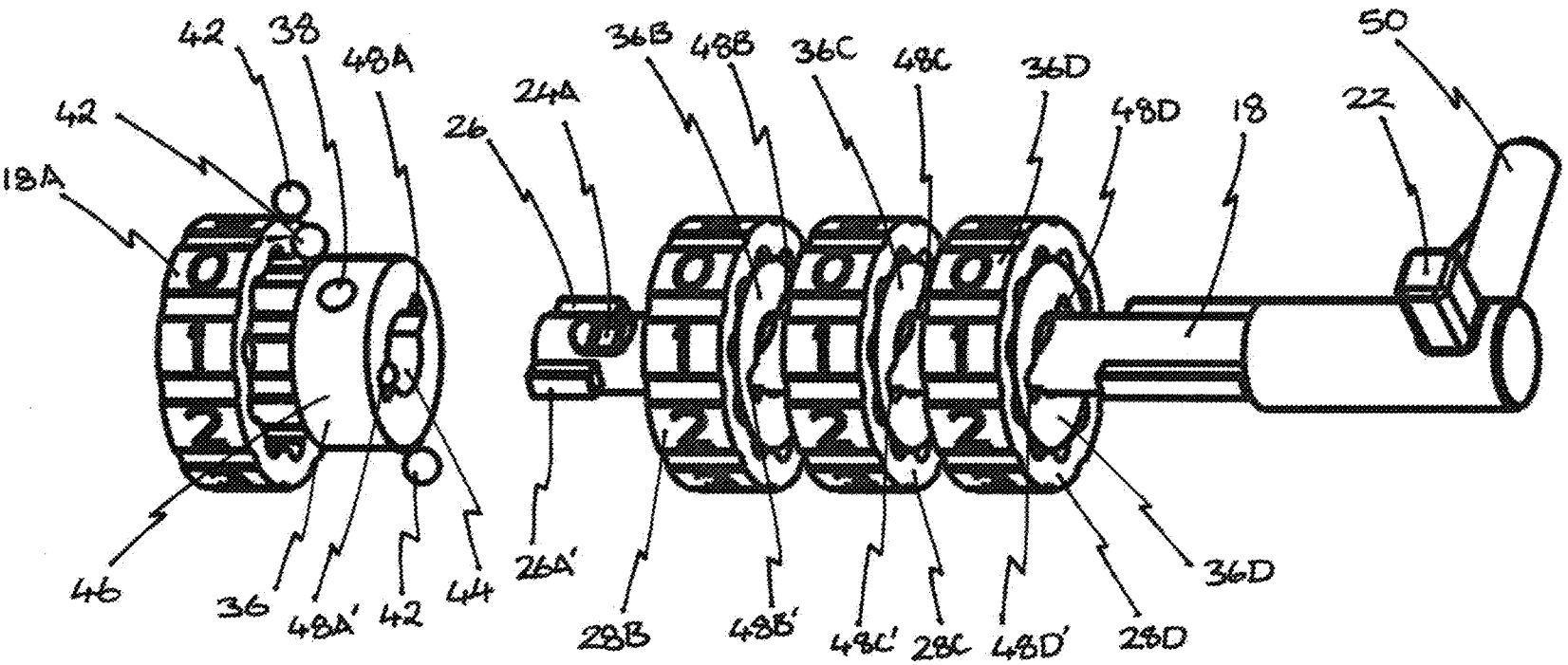
FIG. 3 is a perspective exploded view of some of the components of the device of FIG. 1.
Figure 4:
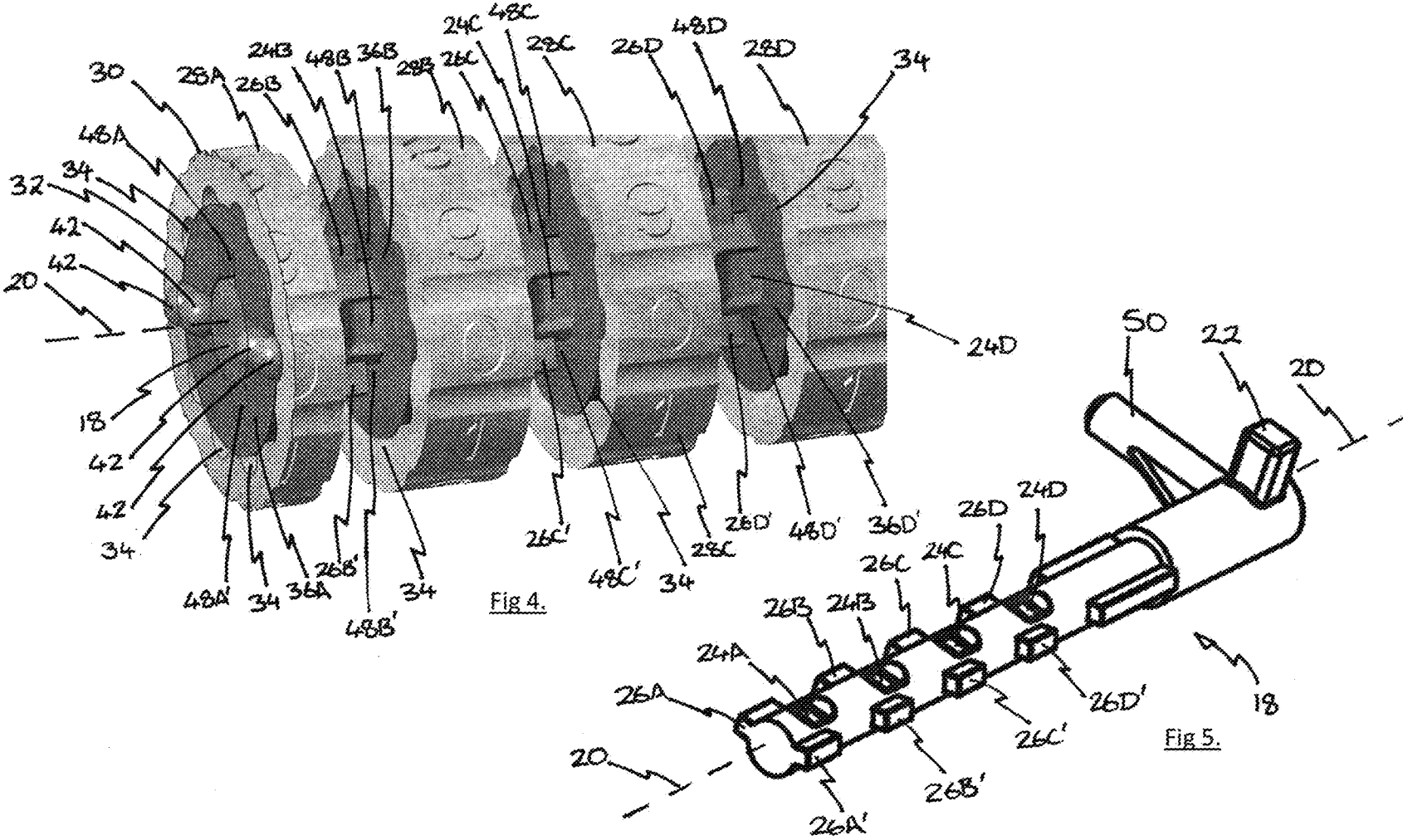
FIG. 4 is an alternative perspective exploded view of some of the components of the device of FIG. 1.

The following description of the preferred embodiment(s) is merely exemplary in nature and is in no way intended to limit the invention, its application, or uses.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

By providing a combination locking device as set out above, the advantage is provided that the code of the locking device can be changed without the use of a tool. In particular, the interference fit between the clutch wheel and the dial in the prior art is removed with the second locking members providing a precise locked or unlocked condition between the gate wheel and the dial in the present invention. As a result, in the present invention, when in the code change condition the dial can freely rotate relative to the gate wheel. Furthermore, by having a dial recess associated with each marker on the dial ensures correct alignment between the gate wheels and dials therefore preventing an operator accidentally recoding the lock between two dial markers. In particular, the spindle is unable to move from the recode condition if the dial is not correctly aligned because the second locking member will not be able to move back into a recess in the dial until the dial is correctly aligned with the aperture in the gate wheel.

In a preferred embodiment the first locking members are fixed to said spindle.

In another preferred embodiment the first locking members comprise protrusions extending from said spindle which engage wheel recesses formed in said gate wheels to prevent said spindle rotating relative to said wheels in said code change condition.

By forming the first locking members as protrusions extending from the spindle the advantages provided that the spindle precisely determines the locked condition. Furthermore, this allows the unlock and recode positions to be the same.

The second locking members may comprise at least one sphere. The second locking members may also comprise a plurality of said spheres.

Forming the second locking members from one or more spheres provides the advantage that these locking members move very easily within the aperture and can easily move in and out of the recesses in the spindle and the dials.

In a preferred embodiment the second locking members comprise a non-magnetic metallic material.

By forming the second locking members from a non-magnetic metallic material the advantage is provided that a magnet cannot be used to determine the position of the aperture in the gate wheel which may assist an unauthorized person from determining the unlocking code.

In another preferred embodiment the spindle is movable between at least three positions including a locked position with said device in said locked condition, a code change position with said device in said code change condition and an unlocked position with said device in an unlocked condition.

By having three positions for the spindle to move between, and in particular having separate positions for the unlock and recode conditions, provides the advantage that the chances of accidentally recoding the lock whilst the devices unlocked are significantly reduced.

In a further preferred embodiment when said spindle is in said code change condition said device is also in an unlocked condition.

This provides the advantage that the mechanism for the lock having the unlock and code change conditions in the same spindle position is simpler.

Referring to the figures, a combination locking device 10 is shown. This example of a combination locking device is typically used for locking bicycles and referred to as a D or U lock. The mechanism of the combination locking device of the present invention is suitable for other combination locking devices including, but not limited to, padlocks and locking bolts.

The locking device 10 has a housing 12 and a U shaped shackle 14. The locking mechanism 16 is contained substantially within the housing 12, although parts of some of the components are visible and manipulatable through the housing. The components of the locking mechanism 16 include a spindle 18 which has an axis 20. Spindle 18 is movable axially within the housing 12 and is maneuvered by manipulation by an operator of a handle 22 which extends through the housing 12. The spindle 18 has a series (in this example four) recesses formed therein and generally labelled as 24 and the individual recesses specifically as 24A, 24B, 24C and 24D. Spindle 18 also has a series of first locking members, generally labelled as 26, which are formed as pairs of protrusions 26A and 26A', 26B and 26B', 26C and 26C', 26D and 26D'.

The locking device 10 also has a plurality of substantially annular dials which are generally labelled 28 and the individual dials specifically labelled 28A, 28B, 28C and 28D which are accessible through the housing 12 (see FIG. 1) for manipulation by an operator. The dials 28 have a plurality of markers which are visible on an external surface 30 of each of the dials. In this example, and as is common practice, the dials 28 are marked with the reference numerals 0 to 9 making a total of 10 markers. An internal surface 32 of annular dial 28 is provided with a plurality of dial recesses 34. Each dial has a recess 34 associated with each marker and as a result there are 10 recesses on the internal surface 32 of each dial 28.

The dials 28 are, in use, positioned coaxially with spindle 18 and located between the dials 28 and the spindle 18 are a plurality of gate wheels which are generally labelled 36 and the individual gate wheels specifically labelled 36A, 36B, 36C and 36D. Each gate wheel 36 has at least one, and in the embodiments shown two, aperture is 38 and 40 extending therethrough perpendicular to the spindle axis 20. When the gate wheels 36 are in use and located between the dials 28 and spindle 18 the apertures provide a pathway between the spindle and the internal surface 32 of the dials. Located within the apertures 38 and 40 are second locking members, in the form of locking balls 42. The main purpose of the locking balls 42 is to selectively allow and prevent rotation of said wheels relative to said dials. In the embodiment shown a pair of locking balls 42 is located in each aperture 38 and 40 and the sum of the diameters of the pair of locking balls 42 is greater than the radial distance from an inner surface 44 of gate wheel 36 to an outer surface 46 of gate wheel 36. In other words, the pair of locking balls 42 does not fit entirely within the aperture 38 or 40 and must extend partially either radially inward or radially outward of the inner and outer surfaces 44 and 46 of gate wheel 36.

Also formed in the gate wheels 36 are pairs of recesses which are generally referred to by reference numeral 48. These gate wheel recesses are associated with the protrusions/first locking members 26 in the spindle 18 and the gate wheel recesses 48 are specifically labelled 48A and 48A', 48B and 48B', 48C and 48C' and 48D and 48D'. The association between the protrusions 26 and the recesses 48 (for each pairing labelled with the suffix A, B, C and D) are such that in one rotational position around axis 20 the protrusions 26 and recesses 48 are aligned so that the spindle 18 can move axially with the protrusions 26 entering the recesses 48. The protrusions 26 and recesses 48 are positioned so as not to be opposite each other around axis 20 and this rotational asymmetry ensures that there is only one correct position in which the spindle 18 can move relative to the gate wheel 36. The protrusions 26 and recesses 48 need not be in the same position for each gate wheel. However in the interests of simple manufacture it is preferable that they are identical.

Operation of the locking device 10 will now be described. The spindle 18 is axially movable relative to the housing 12 by a sliding motion under the control of handle 22. A guide rod 50 which is located in a guide slot 52 in housing 12 ensures linear movement of the spindle and also prevents its rotation. The spindle 18 is able to move between at least two positions, those shown in FIGS. 6 to 8 and FIGS. 9 to 11. The device 10 has three operating conditions namely a locked condition, an unlocked condition and a recode condition. These conditions are selected by movement of the spindle 18 and the position of the spindle may relate to one or more conditions. For example, in the position illustrated in FIGS. 6 to 8, hereinafter referred to as the first position, the device is in the locked condition. In the position illustrated in FIGS. 9 to 11, hereinafter referred to as the second position, the device is in both the unlocked and recode conditions.

Figure 7:
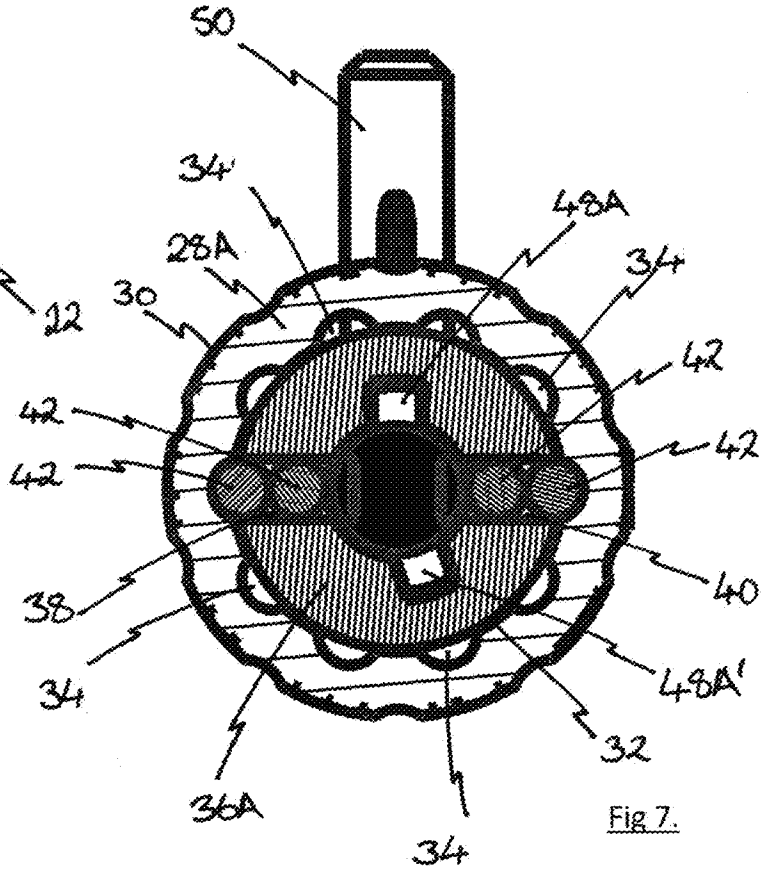
FIGS. 6, 7 and 8 are a front view, a sectional side view along the line A-A and a sectional front view along the line B-B of some of the components of the device of FIG. 1 shown in a locked condition.
Figure 6:
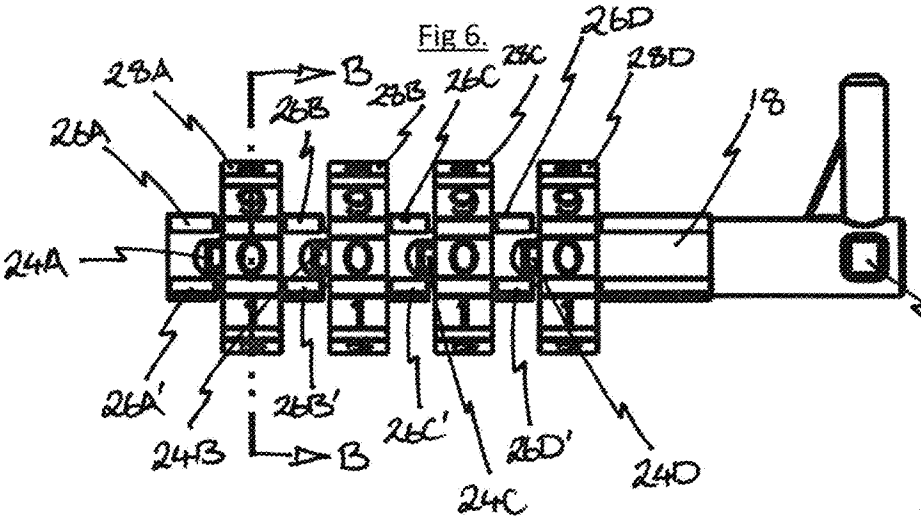
Figure 8:
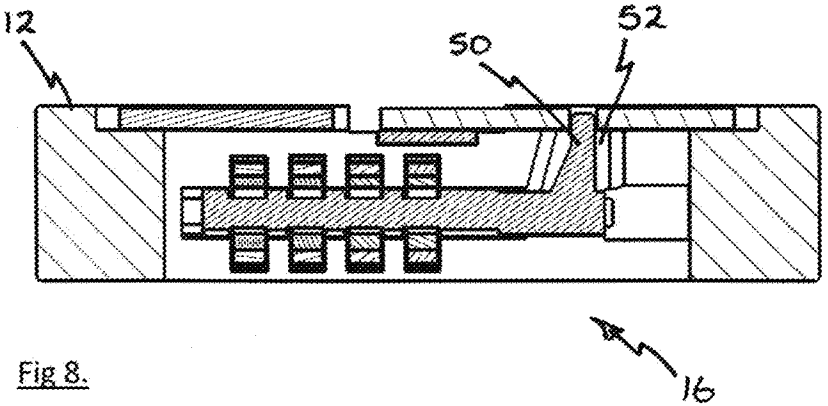
Figure 9:
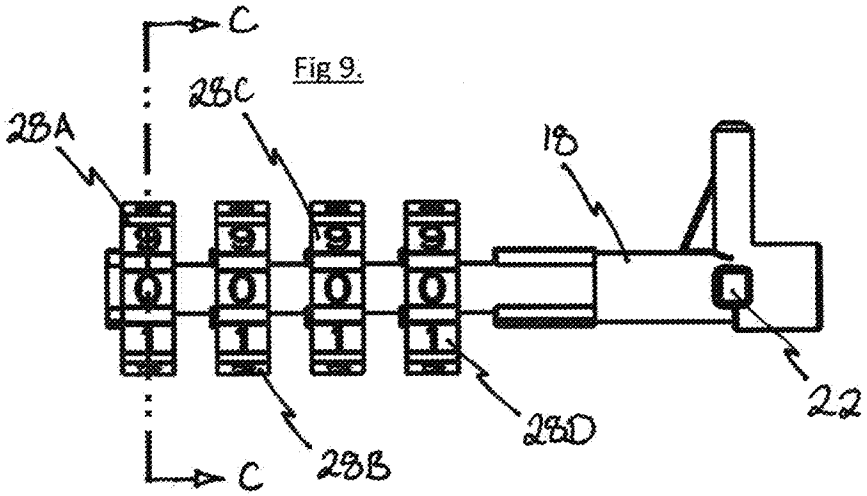

In the first position, locked condition, as illustrated in FIGS. 6 to 8, the locking balls 42 are located within the apertures 38 and 40 and the outermost locking balls extend into two of the dial recesses 34. The inner locking balls engage the spindle 18 and do so on a portion of the spindle 18 that does not include a spindle recess 24 or a protrusion 26. This portion of the spindle provides an annular surface for the inner locking ball to abut and is most clearly seen as the portions of the spindle 18 immediately to the right of each dial 28 as seen in FIG. 9. With the locking balls 42 pressed into engagement in the dial recesses 34 the gate wheel 36 is locked to the dial 28 and these pairs of components must rotate together around the spindle 18.

Also in the first position, the protrusions 26 are located to the left of their dials 28, that is protrusions 26A and 26A' are located to the left of dial 28A and protrusions 26B and 26B' are located to the left of dial 28B etc. As can be seen from FIG. 7 the protrusions 28 are not aligned with the wheel recesses 48 and as a result any attempt to move the spindle 18 to the right (as shown in FIGS. 6 and 8) is prevented by the protrusions 26 engaging the gate wheels 36. If each gate wheel 36 is rotated so that both the protrusions 26 are aligned with the gate wheel recesses 48, by rotation of each dial 24 to the correct marker numeral, then the spindle can move to the right so that the protrusions 26 enter the gate wheel recesses 48. The end of spindle 18 adjacent the guide rod 50 acts on a release mechanism (not shown) which releases the shackle 14 allowing the locking device 10 to be opened. Details of the workings of the shackle release mechanism do not form part of the invention and will be familiar to persons skilled in the art.

Figure 10:
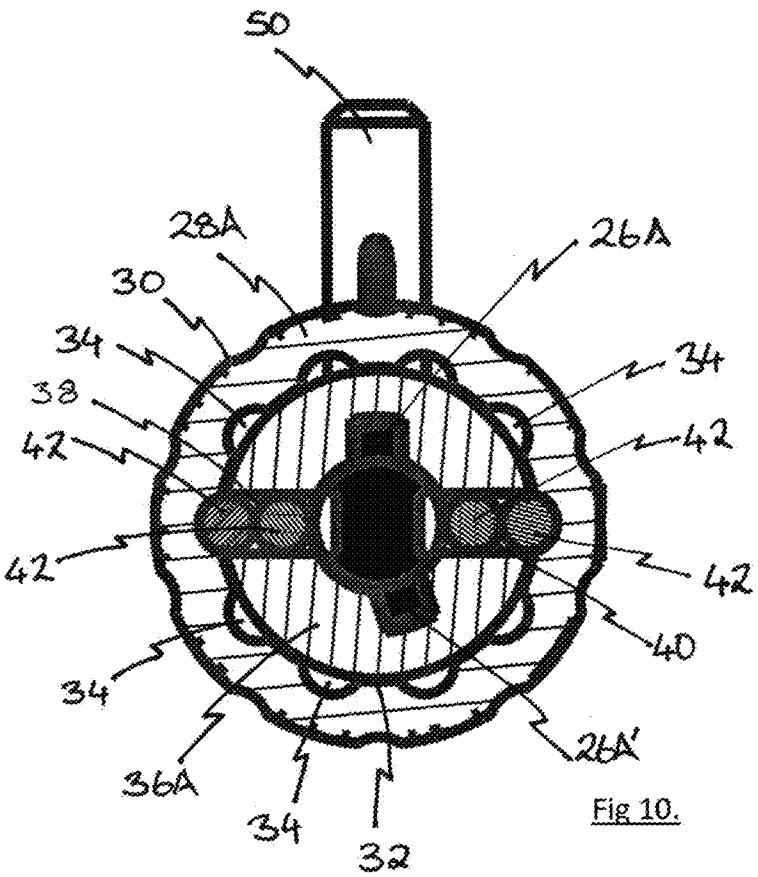
FIGS. 9, 10 and 11 are a front view, a sectional side view along the line A-A and a sectional front view along the line C-C of some of the components of the device of FIG. 1 shown in a code change condition.
Figure 11:
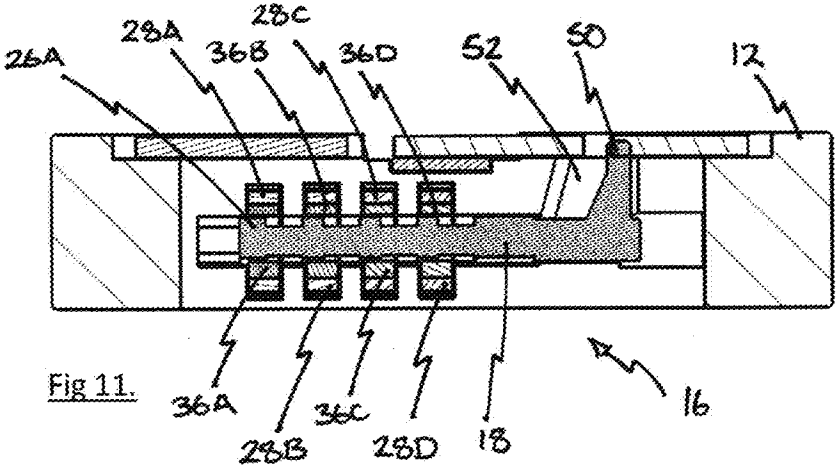

With the spindle 18 now moved to the right the device is in the second position, as illustrated in FIGS. 9 to 11. With the protrusions 26 located within the gate wheel recesses 48 the gate wheels 36 are unable to rotate around the spindle 18. However, when the protrusions 26 are within the gate wheel recesses 48 the apertures 38 and 40 become aligned with the spindle recesses 24. As a result, the locking balls 42 are able to move radially inwards into the spindle recesses 24. Because the spindle recesses 24 are a similar depth to the dial recesses 34 the locking balls 42 are able to move from the dial recesses thereby unlocking the dials 28 from fixed engagement with the gate wheels 36. The dials 28 can therefore be rotated around the gate wheels 36 and this recodes the locking device 10. Once each of the dials 28 has been positioned to the new desired code the handle 22 can be moved back in a leftwards direction returning the device to the first position and locked condition and the new code has been set. If the dial recesses 34 are not correctly aligned with the apertures 38 and 40 the spindle 18 will not be able to move leftwards as the locking balls 42 abut the internal surface 32 of the dial 28 and will not be able to move radially outwards from the spindle recess 24.

If the dial recesses 34 are correctly aligned with the apertures 38 and 40 and the spindle 18 is moved in a leftwards direction, the spindle recesses 24 will no longer be in alignment with the apertures 38 and 40 the gate wheels. The curved cam surface of the spindle recess 24 pushes the innermost locking balls 42 in a radially outward direction which pushes the outermost locking balls in the same direction causing them to re-enter the dial recesses 34. The spindle 18 prevents radially inward movement of locking balls and therefore the gate wheels 36 are locked to the dials 28. It is desirable that the spindle 18 is biased towards the first position by biasing means, in the form of a suitable spring (not shown).

In an alternative embodiment the spindle 18 may be moved between three positions with each position relating to a different locked condition. For example, a central position may relate to a locked condition with movement of the spindle in one direction moving to an unlocked condition (assuming the dials are correctly aligned to the locking device code) and movement in the other direction moving the spindle to a recode condition (also assuming the dials are correctly aligned with the locking device code).

It will be appreciated by persons skilled in the art that the above embodiments have been described by way of example only and not in any limitative sense, and that various alterations and modifications are possible without departure from the scope of the protection which is defined by the appended claims. For example, the pair of locking balls 42 could be replaced by a single locking ball by varying the size of the locking ball and/or the radial thickness of the gate wheel 36 as measured from the inner surface 44 to the outer surface 46. Furthermore, the locking ball could be replaced with an alternative second locking member in the form of a non-spherical locking member, such as a rod, which is able to slide in the aperture is 38 and 40 in the gate wheel. The thickness of the locking member or combined thickness of locking members sitting within an aperture should be slightly larger than the radial thickness of the gate wheel and should be approximately equal to the radial thickness of the gate wheel plus the depth of one of the dial recesses and the spindle recesses. It is also the case that number of protrusions and associated gate wheel recesses can be varied from two. One is possible and three or more can be used as long as they are positioned with rotational asymmetry around the spindle.

Furthermore, the locking member described above can be used on other locking devices including padlocks and locking bolts. By way of example, the mechanism could be incorporated into a device similar to that disclosed in our previously mentioned publication EP1837466, details of which are hereby incorporated by reference. The mechanism of that padlock can be amended by replacing the spindle, digit clutch wheels, clutches and dials with a similar spindle but with recesses, gate wheels, locking balls and dials described above.

What is claimed is:

1. A combination locking device comprising:

a housing;

a spindle axially movable within said housing and having a plurality of recesses formed therein;

a plurality of annular dials accessible through said housing for manipulation by an operator, the annular dials having a plurality of markers visible on an external surface thereof and having a plurality of recesses, associated with said markers, on an internal surface;

a plurality of gate wheels each having at least one aperture extending therethrough providing a pathway between said spindle and said internal surface of said annular dials;

a plurality of first locking members for allowing and preventing rotation of said spindle relative to said gate wheels; and a plurality of second locking members located within said apertures for allowing and preventing rotation of said gate wheels relative to said annular dials, wherein said spindle is movable to produce a plurality of device conditions including:

a locked condition wherein said gate wheels are rotatable around said spindle and said apertures are not aligned with said recesses of said spindle so that said gate wheels are locked to said annular dials by said second locking members; and a code change condition wherein said gate wheels are locked to said spindle by said first locking members and said apertures are aligned with said recesses of said spindle so that said second locking members can move thereby allowing said annular dials to move relative to said gate wheels.

2. The device according to claim 1, wherein said first locking members are fixed to said spindle.

3. The device according to claim 2, wherein said first locking members comprise protrusions extending from said spindle which engage wheel recesses formed in said gate wheels to prevent said spindle rotating relative to said gate wheels in said code change condition.

4. The device according to claim 1, wherein said second locking members comprise at least one sphere.

5. The device according to claim 4, wherein said second locking members comprise a plurality of said spheres.

6. The device according to claim 1, wherein said second locking members comprise a non-magnetic metallic material.

7. The device according to claim 1, wherein said spindle is movable between at least three positions including a locked position with said device in said locked condition, a code change position with said device in said code change condition and an unlocked position with said device in an unlocked condition.

8. The device according to claim 1, wherein when said spindle is in said code change condition said device is also in an unlocked condition.

9. The device according to claim 1 wherein each of said plurality of gate wheels comprises an inner surface facing said spindle and an outer surface facing said internal surface of one of said annular dials, and wherein said at least one aperture of each of said plurality of gate wheels extends radially through said gate wheel from said inner surface to said outer surface.

10. The device according to claim 9 wherein said second locking members have a thickness that is greater than a thickness of said gate wheel measured between the inner and outer surfaces of said gate wheel.

11. The device according to claim 1 wherein each of said gate wheels is located between the internal surface of one of said annular dials and said spindle.

12. The device according to claim 1 wherein the at least one aperture of each of said plurality of gate wheels extends perpendicular to an axis of said spindle.

13. The device according to claim 1 wherein in said code change condition said apertures are aligned with said recesses of said spindle so that said second locking members can move radially inwards into said recesses of said spindle thereby allowing said annular dials to move relative to said gate wheels.

* * * * *